US012214411B2

(12) United States Patent
Guse

(10) Patent No.: US 12,214,411 B2
(45) Date of Patent: Feb. 4, 2025

(54) FAST CHANGE FOLD-A-WAY CROSS BOW SWING ARM MULTIPLE DIE TUBING BENDER

(71) Applicant: Ritchie Engineering Company, Inc., Bloomington, MN (US)

(72) Inventor: Gregory M. Guse, Bloomington, MN (US)

(73) Assignee: Ritchie Engineering Company, Inc., Bloomington, MN (US)

( * ) Notice: Subject to any disclaimer, the term of this patent is extended or adjusted under 35 U.S.C. 154(b) by 148 days.

(21) Appl. No.: 18/117,682

(22) Filed: Mar. 6, 2023

(65) Prior Publication Data

US 2023/0278089 A1 Sep. 7, 2023

Related U.S. Application Data

(60) Provisional application No. 63/317,233, filed on Mar. 7, 2022.

(51) Int. Cl.
*B21D 7/06* (2006.01)
*B21D 9/04* (2006.01)

(52) U.S. Cl.
CPC ..... *B21D 9/04* (2013.01); *B21D 7/063* (2013.01)

(58) Field of Classification Search
CPC ..... B21D 7/04; B21D 7/06; B21D 7/063
See application file for complete search history.

(56) References Cited

U.S. PATENT DOCUMENTS 2,464,459 A 3/1949 Newlon
2,696,132 A 12/1954 Ralston
3,785,190 A 1/1974 Schall et al.
4,568,864 A 2/1986 Gisske
4,986,104 A 1/1991 Caporusso et al.
5,022,249 A 6/1991 Caporusso et al.
5,301,530 A 4/1994 Beelen et al.
5,761,950 A * 6/1998 Chiu ..... B21D 7/063 72/389.9

(Continued)

FOREIGN PATENT DOCUMENTS

CN 2011204728753 U 7/2012
FR 3026971 B1 * 12/2016 ..... B21D 43/26

OTHER PUBLICATIONS

PCT International Search Report. Jun. 29, 2023.
Rems Akku-Curvo 22V, Rems GmbH & Co KG, Waiblingen, Copyright 2019.

*Primary Examiner* — Debra M Sullivan
(74) *Attorney, Agent, or Firm* — FERENCE & ASSOCIATES LLC

(57) ABSTRACT

A tubing bender device includes a frame, handle, ratchet mechanism, slide rod and a frame notch. The tubing bender may be easily disassembled and assembled into a forward or reverse configuration through the use of connectors, two brackets and a bending mandrel. Reversibility is also provided by a cross bow bar support releasably secured to either the slide rod or to a bracket. The cross bow bar support may also be inverted to position die heads in either an upward or downward direction. Repositionable die heads may also be rotated relative to the support into an operative configuration when bending smaller diameter tubing. The repositionable die heads are rotated relative to the support into a non-operative configuration when bending larger diameter tubing.

20 Claims, 6 Drawing Sheets

(56) References Cited

U.S. PATENT DOCUMENTS

| | | | | |
|---|---|---|---|---|
| 6,931,908 | B1 | 8/2005 | Mitson | |
| 7,028,521 | B2 | 4/2006 | Fan | |
| 7,900,495 | B2 | 3/2011 | Latoria | |
| 9,144,835 | B2 | 9/2015 | Houle | |
| 9,162,273 | B1 * | 10/2015 | Chiu | B21D 7/022 |
| 9,358,593 | B1 | 6/2016 | Hopper | |
| 9,433,988 | B1 | 9/2016 | Huang | |
| 10,189,069 | B1 | 1/2019 | Huang | |
| 2007/0074559 | A1 * | 4/2007 | Boulin | B21D 7/063 72/389.9 |
| 2008/0190164 | A1 | 8/2008 | Boon et al. | |

* cited by examiner

FAST CHANGE FOLD-A-WAY CROSS BOW SWING ARM MULTIPLE DIE TUBING BENDER

CROSS-REFERENCE TO RELATED APPLICATIONS

This application claims the benefit of U.S. Provisional Patent Application Ser. No. 63/317,233 filed Mar. 7, 2022 the entire contents of which being incorporated by reference herein in its entirety.

FIELD OF THE INVENTION

This invention relates to the reconfiguration of stock or straight copper tubing which is also referred to as piping in Heating, Ventilation and Air Conditioning applications. (Hereinafter HVAC) The invention includes a multifunctional cross bow bar support as well as the integration of a fast change system for the transition from forward to reverse bends and back with a selectable size die head.

BACKGROUND

HVAC technicians typically receive coils or straight copper tubing or piping for installation in field applications. Some field applications occur in the construction industry, the automotive industry and/or repair of HVAC systems or equipment previously used with buildings or automobiles. The invention is suitable for use in other industries where bending of tubing or pipe is required. HVAC technicians frequently require the formation of clean and uniform bends in copper tubing which necessitate the use of specialized tools which do not crush or kink the tubing or piping during the formation of the desired bend radius, or the transition or the reformation of copper tubing from one direction to another.

The visual appearance of a completed project is of importance to HVAC technicians improving the reputation and goodwill for the person or entity. Visual deformities or imperfections in the continuity and/or uniformity of the tubing or piping reflects poorly on the technicians or their employer.

Currently multiple ways exist for a HVAC technician to bend tubing for a project. Some of the methods for bending tubing include bending by hand which leads to crushing and inconsistent bends in the tubing; the use of a spring placed onto the exterior of the tube which reduces crushing, but does not provide a controlled angular bend; and the use of a hand squeezing mechanical device, an electrically powered device or a hydraulically powered device to impart a force to push a bending mandrel having bending implements against a tube.

Within an HVAC application it is common for each piping run to consist of two pipes, where one pipe is for high pressure and one pipe is for low pressure where each of the runs requires matching bends for the provision of a clean system layout.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entirety.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

The invention relates to a mechanical device of a ratcheting style interchangeable crossbow design tubing bender. During tube bending a compressing force from a hand is transmitted mechanically to a sliding force pushing a bending mandrel against the tube and the cross bow bar support having die heads, allowing for the tubing to be formed into any bend angle from a zero to nearly 110 degree bend. Alternatively, during tube bending, a compressing force from a hand is transmitted mechanically to a sliding force pushing the slide rod releasably secured to a bracket. The bracket releasably holds the cross bow bar support having die heads, against the tube. The cross bow bar support having die heads moves the tube against the bending mandrel which is releasably attached to another bracket. The second bracket in turn is releasably attached to a frame notch. The bending configuration enables a tube to be formed into any desired bend angle from zero to nearly a 110 degree bend.

In one alternative embodiment, a pipe bending device includes a frame having a handle, a ratchet mechanism engaged to a slide rod and the handle, and a frame notch proximate to an outer end of the frame. The frame has a first bending configuration including a bending mandrel, the bending mandrel having a first bracket receiving aperture. The first bracket receiving aperture is releasably engaged to the slide rod. The frame has a cross bow bar support which is releasably engaged to the frame notch. The cross bow bar support includes a plurality of die heads releasably engaged to the cross bow bar support, the die heads having a degree of revolution relative to the cross bow bar support. The cross bow bar support also includes a plurality of repositionable die heads which are releasably engaged to the cross bow bar support. The repositionable die heads have the degree of revolution relative to the cross bow bar support and a degree of rotation relative to the cross bow bar support. Each of the die heads have at least one die head pipe receiving recess having a radius dimension, and each of the repositionable die heads having at least one repositionable die head pipe receiving recess having a radius dimension being different from the radius dimension of the die head pipe receiving recess. The die heads or the die heads and the repositionable die heads are aligned relative to the bending mandrel in an first configuration operative position. The die heads or the die heads and the repositionable die heads and the bending mandrel are constructed and arranged for bending a pipe in a first bending direction, and further the repositionable die heads are rotated downwardly below the cross bow bar support in a first configuration non-operative position.

In another alternative embodiment, a pipe bending device includes a frame having a second bending configuration comprising a first support bracket releasably engaged to the slide rod, the cross bow bar support being releasably engaged to the first support bracket. A second support bracket is releasably engaged to the frame notch. The bending mandrel is releasably engaged to the second support bracket. The die heads or the die heads and the repositionable die heads are aligned relative to the bending mandrel in a second configuration operative position. The die heads or the die heads and the repositionable die heads and the bending mandrel are constructed and arranged for bending pipe in a second bending direction, the second bending direction being opposite to the first bending direction. In the second bending direction the repositionable die heads are rotated upwardly above the cross bow bar support into a second configuration non-operative position.

In one embodiment, the cross bow support includes interchangeable die heads and interchangeable repositionable die heads which extend outwardly from the cross bow support in the same direction.

The interchangeable die heads and interchangeable repositionable die heads are designed to be used in matched working pairs. The interchangeable die heads are designed for use in bending pipe having a relatively larger diameter dimension. The interchangeable repositionable die heads are designed for use in bending pipe having a relatively smaller diameter dimension.

The interchangeable die heads and interchangeable repositionable die heads each revolve in either a clockwise direction or a counter clockwise direction relative to the cross bow bar support.

When bending pipe having a relatively larger diameter dimension the interchangeable repositionable die heads may be rotated upwardly or downwardly relative to the cross bow bar support into a non-interference and non-operative position. The rotation in the upward or downward direction of the interchangeable repositionable die heads will be dependent upon the configuration of the tubing bender as assembled into a forward or reverse bending configuration.

Each of the interchangeable die heads preferably has a plurality of opposite faces. The interchangeable die heads are shown as having two opposing faces. In other embodiments, the interchangeable die heads may have between three and ten opposing faces as required for bending pipe. One of the opposite faces for each of the interchangeable die heads includes a matching pipe receiving recess, designed to receive a specific size of pipe. The other of the opposite faces for each of the interchangeable die heads includes a matching pipe receiving recess to receive a different size of pipe.

Each of the interchangeable repositionable die heads preferably has a plurality of opposite faces. The interchangeable repositionable die heads are shown as having two opposing faces. In other embodiments, the interchangeable repositionable die heads may have between three and ten opposing faces as required for bending pipe. One of the opposite faces for each of the interchangeable repositionable die heads includes a matching pipe receiving recess to receive a specific smaller size of pipe. The other of the opposite faces for each of the interchangeable repositionable die heads includes a matching pipe receiving recess to receive a different smaller size of pipe.

The cross bow bar support provides flexibility in that an individual may select working pairs of either the interchangeable die heads or the interchangeable repositionable die heads to replace an existing working pair of interchangeable die heads or the interchangeable repositionable die heads, in order to bend a different sized diameter pipe as required by a particular project.

In addition, the pipe bending device may be quickly and easily converted from a forward bending configuration into a rearward bending configuration.

In the forward bending configuration, the bending mandrel includes a receiving aperture which releasably receives the outer end of the slide rod. The pipe receiving channel of the bending mandrel extends outwardly from the handle and ratchet mechanism towards the distal end of the frame. A frame notch is located at the distal end of the frame. The cross bow bar support is releasably attached to the frame notch by a fastening device which in one embodiment may be a wingnut. In the forward bending configuration the cross bow bar support positions the interchangeable die heads and the interchangeable repositionable die heads in a upward direction for alignment of the pipe receiving channel with the pipe receiving recess. The interchangeable repositionable die heads may be rotated downwardly from the cross bow bar support into a non-interference location, and non-operative position during the bending of pipe having a larger size diameter. In the forward bending direction, the bending mandrel is advanced outwardly by the ratchet mechanism towards and against the fixed position of the cross bow bar support and interchangeable die heads or interchangeable repositionable die heads, where advancement of the bending mandrel is continued until a desired bending angle has been obtained for the pipe.

In the reverse bending configuration, a first support bracket includes a receiving aperture which releasably receives the outer end of the slide rod and is releasably attached thereto by a fastening device which in one embodiment may be a wingnut. At the opposite end of the first support bracket away from the slide rod, the cross bow bar support is releasably attached to the first support bracket by a fastening device which in one embodiment may be a wingnut. In the reverse bending configuration the cross bow bar support positions the interchangeable die heads and the interchangeable repositionable die heads in a downward direction for alignment with the pipe receiving channel with the pipe receiving recess. A second support bracket having an attachment end is releasably attached to the frame notch through the use of a fastening device which in one embodiment may be a wingnut. The second support bracket extends outwardly away from the frame of the tube bender. The second support bracket includes a vertical portion having a mandrel post on the inside of the vertical portion. The receiving aperture of the bending mandrel releasably receives the mandrel post positioning the pipe receiving channel of the bending mandrel in the opposite direction related to the forward bending configuration. In the reverse bending configuration the bending mandrel and the pipe receiving channel face inwardly toward the frame and the slide rod of the bending device. The interchangeable repositionable die heads may be rotated upwardly relative to the cross bow bar support into a non-interference location, and non-operative position during the bending of pipe having a larger size diameter. In the reverse bending direction the cross bow bar support is advanced outwardly by the ratchet mechanism towards and against the fixed position of the bending mandrel. The interchangeable die heads or interchangeable repositionable die heads are advanced toward the fixed location bending mandrel until a desired bending angle has been obtained for the pipe.

The tube bending device will additionally include any desired number of bending mandrels where each of the bending mandrels will include a back mandrel wall having the first bracket vertical receiving aperture. Opposite to the back mandrel wall will be located the pipe receiving channel. Each bending mandrel will include a different exterior bending radius and a different sized internal pipe receiving channel. Therefore, for the bending of pipe having a particular diameter size, one or more replaceable bending mandrels may be selected dependent on the bend radius desired to accommodate a particular project.

In addition, pairs of interchangeable die heads and interchangeable repositionable die heads may be selected to match the size dimension selected for the pipe receiving channel of the selected bending mandrel.

While the foregoing is a description of some of the embodiments for carrying out the invention for the purposes of complying with 37 C.F.R. 1.72., it is also intended in an illustrative rather than a restrictive sense. Variations to the exact embodiment described may be apparent to those skilled in such equipment without departing from the spirit and scope of the invention as defined by the claims set out below.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

Figure 1:
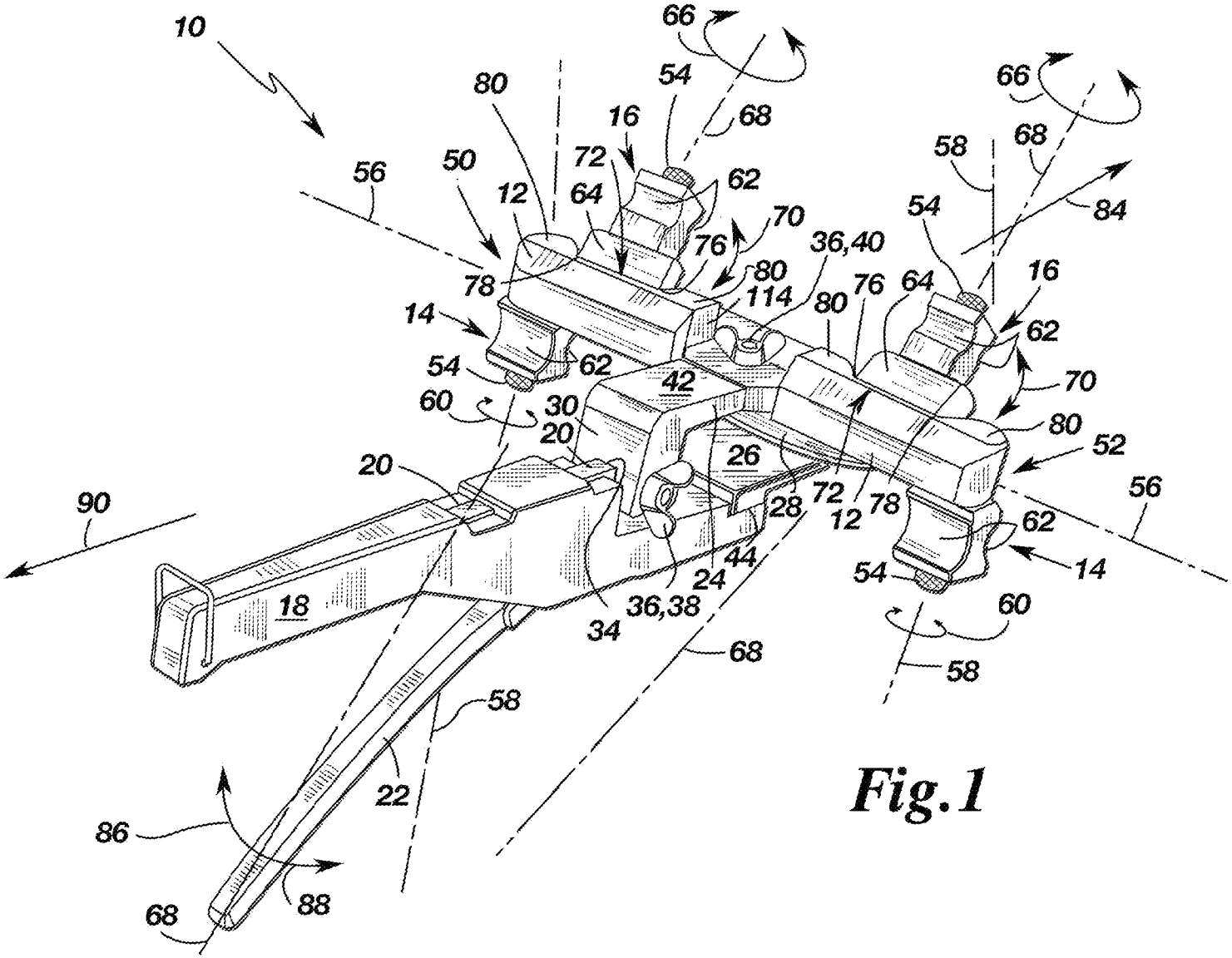
FIG. 1 is a rear isometric perspective view of one alternative embodiment of the tube/pipe bending device.

In at least one embodiment, as depicted in FIG. 1 the Fast Change Fold-A-Way Cross Bow Swing Arm Multiple Die Tubing Bender is identified by reference numeral 10. (Hereinafter referred to as tubing bender 10)

Tubing bender 10 in some embodiments includes a removable quick change cross bow bar support 12 having a plurality of replaceable die heads 14 and replaceable and repositionable die heads 16. The tubing bender 10 also includes a frame 18, a slide rod 20 which is repositionable relative to the frame 18, and a handle 22 pivotally engaged to both of the frame 18 and slide rod 20. The tubing bender 10 also includes a first support bracket 24, a second support bracket 26 and a bending mandrel 28.

In at least one embodiment the first support bracket 24 includes a vertical portion 30 and a horizontal portion 32. The vertical portion 30 also includes a first bracket vertical receiving aperture 34 which may be square or rectangular in shape. The first bracket vertical receiving aperture 34 slidably and releasably receives the forward end of the slide rod 20, which will have the same shape as the first bracket vertical receiving aperture 34.

The vertical portion 30 also includes a threaded first bracket horizontal affixation aperture 38 which is normal relative to, and is in communication with the first bracket vertical receiving aperture 34. Following the insertion of the forward end of slide rod 20 into the first bracket vertical receiving aperture 34, a releasable affixation member 36, which in one embodiment may be a wingnut, may be inserted into the threaded first bracket horizontal affixation aperture 38 and tightened, establishing a pressure contact with the exterior surface of the forward end of slide rod 20.

In at least one embodiment the horizontal portion 32, at the forward end, includes a centrally disposed threaded first bracket vertical affixation aperture 40. Another releasable affixation member 36, which in one embodiment may be a wingnut, may pass through the first bracket vertical affixation aperture 40 of the central portion 42 to releasably secure the cross bow bar support 12 to the horizontal portion 32.

In at least one embodiment the frame 18, at the forward end includes a frame notch 44. The frame notch 44 includes a centrally disposed threaded second bracket vertical affixation aperture 46 which preferably receives another releasable affixation member 36, which in one embodiment may be a wingnut, which releasably secures the second support bracket 26 to the frame notch 44 and frame 18. The affixation member 36 is preferably disposed below and underneath the frame notch 44 and frame 18 and passes upwardly through the second bracket vertical affixation aperture 46, and a second bracket vertical attachment aperture 48, to releasably secure the second support bracket 26 to the frame notch 44 and the frame 18.

The affixation members 36 preferably enable an individual to quickly remove and/or reassemble the respective affixation members 36 from each of the first bracket horizontal affixation aperture 38, second bracket vertical affixation aperture 46 and second bracket vertical attachment aperture 48, in order to separate or attach the first support bracket 24 from/to the slide rod 20, the cross bow bar support 12 from/to the horizontal portion 32 and the second support bracket 26 from/to the frame notch 44 and frame 18.

In at least one embodiment, the cross bow bar support 12 has a centerline and has a first side 50 and a second side 52 and a recessed bridge 112 there between. The centerline bisects the recessed bridge 112. In a reverse bending configuration, proximate to the distal end of the first side 50, a first die head 14 extends normally away from the cross bow bar support 12 in a downward direction. In addition, proximate to the distal end of the second side 52, a second die head 14 extends normally away from the cross bow bar support 12 in a downward direction. Each of the first and second die heads 14 are preferably releasably secured to the respective first side 50 and second side 52 by a die head attachment 54. In one embodiment the die head attachment 54 includes a knurled grasping end, a smooth portion adjacent to the knurled grasping end and a threaded portion adjacent to the smooth portion opposite to the knurled grasping end, where the threaded portion is used to releasably secure the respective die head 14 to the cross bow bar support 12.

In one embodiment, the cross bow bar support 12 includes a longitudinal axis depicted by line 56. During use in bending pipe, tubing or conduit, each of the respective die heads 14 freely revolve in either a clockwise or a counter clockwise direction about a die head axis 58, as represented by arrow 60. Die head axis 58 is preferably in a direction normal to the longitudinal axis 56 extending downwardly therefrom in a first pipe bending direction or configuration. For convenience, the first pipe bending direction or configuration will be referred to as a reverse pipe bend configuration. In the reverse pipe bend configuration the distal ends of the pipe are bent in a direction away from an individual grasping the handle 22 until such time as a desired bend angle is achieved upon a pipe as required for a particular application.

In one embodiment, each of the die heads 14 include two opposite faces, each opposite face having a desired arcuate radius for a concave pipe receiving recess 62. It should be noted that the arcuate radius for a pipe receiving recess 62 is identical to the arcuate radius pipe receiving recess 62 on one face of the other die head 14. The matching pipe receiving recess 62 for each of the two die heads 14 is used as a working pair during the bending of pipe. In addition, each of the die heads 14 is located an equal distance dimension from the centerline of cross bow bar support 12 to facilitate the provision of an equal bending radius to be formed into a pipe 92 during the pipe bending procedure. It is not required that the arcuate radius for a pipe receiving recess 62 to be identical to the arcuate radius on the opposite face on the same die head 14. However, both of the paired die heads 14 should have the same arcuate radius on each of the opposite faces, for use as working pairs during the bending of pipe.

In at least one alternative embodiment, if a different sized arcuate radius for the two pipe receiving recess 62's of the two die heads 14 is desired, for bending pipe having a larger or smaller diameter, then an individual may release the die head attachments 54 and replace the die heads 14 with substitute die heads 14 having the desired arcuate radius for the working pairs of the pipe receiving recess 62.

In a preferred embodiment the die heads 14 are interchangeable and/or replaceable in matched working pairs. It should be noted that the die heads 14 have a first or a single degree of revolution about the die head axis 58 as provided by the die head attachment 54.

In some embodiments the cross bow bar support 12 includes a plurality of die heads 14 releasably engaged to the cross bow bar support 12, the die heads 14 having a degree of revolution relative to the cross bow bar support 12. The cross bow bar support also includes a plurality of repositionable die heads 16 which are releasably engaged to the cross bow bar support. It is anticipated that 1, 2, 3, 4 or more die heads 14 may releasably engaged to the cross bow bar support 12. It is also anticipated that 1, 2, 3, 4 or more repositionable die heads 16 may releasably engaged to the cross bow bar support 12.

Each of the die heads 14 and the repositionable die heads 16 have a degree of revolution relative to the cross bow bar support 12. The repositionable die heads 16 also have a degree of rotation relative to the cross bow bar support 12.

Each of the die heads 14 and repositionable die heads 16 have at least one pipe receiving recess 62 having a radius dimension. The radius dimension between the pipe receiving recesses 62 may be identical or different depending upon a required application or project.

In alternative embodiments the interchangeable die heads 14 preferably have a plurality of opposite faces. The interchangeable die heads 14 are shown in the figures as having two opposing faces. In other embodiments, the interchangeable die heads 14 may have between three and ten opposing faces as required for bending pipe. One of the opposite faces for each of the interchangeable die heads 14 includes a matching pipe receiving recess 62, designed to receive a specific size of pipe. The other of the opposite faces for each of the interchangeable die heads 14 includes a matching pipe receiving recess to receive a different size of pipe.

In alternative embodiments, each of the interchangeable repositionable die heads 16 preferably has a plurality of opposite faces. The interchangeable repositionable die heads 16 are shown in the figures as having two opposing faces. In other embodiments, the interchangeable repositionable die heads 16 may have between three and ten opposing faces as required for bending pipe. One of the opposite faces for each of the interchangeable repositionable die heads 16 includes a matching pipe receiving recess 62 to receive a specific smaller size of pipe. The other of the opposite faces for each of the interchangeable repositionable die heads 16 include a matching pipe receiving recess to receive a different smaller size of pipe.

The cross bow bar support 12 provides flexibility in that an individual may select working pairs of either the interchangeable die heads 14 or the interchangeable repositionable die heads 16 to replace an existing working pair of interchangeable die heads 14 or the interchangeable repositionable die heads 16, in order to bend a different sized diameter pipe as required by a particular project.

In addition, the pipe bending device may be quickly and easily converted from a forward bending configuration into a rearward bending configuration as described herein.

In an alternative embodiment, the cross bow bar support 12 includes a plurality of repositionable die heads 16. Each repositionable die head 16 is positioned between a respective die head 14 and the recessed bridge 112 of the cross bow bar support 12. Each repositionable die head 16 is independently repositionable in either a vertically downward or vertically upward direction relative to the longitudinal axis 56, as depicted by arrow 70, viewing FIG. 1 from the right to the left. The degree of upward or downward rotation for the repositionable die heads 16 may be as large as 160 degrees. In a fully downward position, in the reverse bending configuration, the repositionable die heads 16 will be aligned relative to, an adjacent die head 14, establishing an operative configuration. In the fully downward position the axis of revolution 68 of the repositionable die heads 16 will be substantially perpendicular relative to the longitudinal axis 56 of the cross bow bar support 12. The downward rotation of the repositionable die heads 16 does not permit the displacement beyond a normal or perpendicular position relative to the cross bow bar support 12 and longitudinal axis 56.

In addition, each of the repositionable die heads 16 is located an equal distance dimension from the centerline of cross bow bar support 12, to facilitate the provision of an equal bending radius to be formed into a pipe 92 during the pipe bending procedures. The repositionable die heads 16 are preferably used during the bending of pipe 92 having a smaller diameter dimension. The repositionable die heads 16, like the die heads 14, will also rotate about the axis of revolution 68 and slide along the pipe 92 as the bending mandrel 28 advances during pipe bending activities in the reverse bend configuration.

Alternatively, the repositionable die heads 16 may be upwardly repositioned relative to longitudinal axis 56 for placement into a non-operative configuration, where the repositionable die heads 16 are disposed above, and do not interfere with the operation of the bending mandrel 28 during the bending of pipe.

Each of the repositionable die heads 16 independently revolve about, and are releasably secured, in a normal or perpendicular direction to a mounting block 64, though the use of a die head attachment 54 as earlier described. Revolution of the repositionable die heads 16 relative to the mounting blocks 64 about an axis of revolution 68 is depicted by arrow 66. The revolution of the repositionable die heads 16 about the axis of revolution 68 is established by the die head attachments 54.

In a preferred embodiment the repositionable die heads 16 are substantially identical in size and function as earlier describer with respect to the die heads 14, except with respect to the upward or downward rotation and repositioning relative to the cross bow bar support 12, and to the longitudinal axis 56. In addition, the pipe receiving recess 62 on the repositionable die heads 16 may have either a smaller or larger arcuate radius for contact to, and the bending of, smaller or larger diameter pipe as compared to the pipe receiving recess 62 on the die heads 14. In the preferred embodiment the repositionable die heads 16 are used in the bending of pipe having a smaller diameter dimension.

In a preferred embodiment, each repositionable die head 16 includes a plurality of faces, each face having a pipe receiving recess 62, which is identical in dimension to a pipe receiving recess 62 on one or more of the faces of a plurality of other repositionable die heads 16. During use in bending pipe, one face of each of plurality of repositionable die heads 16 having the same dimension for the pipe receiving recess 62, may be used as a matched working pair or in another desired configuration on the cross bow bar support 12 on an appropriate sized pipe. The repositionable die heads 16 may be releasably interchangeable or exchanged for another pair of repositionable die heads 16 having matching pipe receiving recess 62 as required for bending of a particular pipe size.

It should be noted that the repositionable die heads 16 have at least two degrees of revolution and rotation. The repositionable die heads 16 have a first degree of revolution about the axis of revolution 68 as provided by the die head attachment 54. In addition, the repositionable die heads 16 have a second degree of rotation about a shaft or pin 74 permitting upward or downward repositioning relative to the longitudinal axis 56 for placement into a first operative working configuration or a second elevated or downward non-operative or non-working configuration for the tubing bender 10.

In at least one embodiment, the cross bow bar support 12 includes at least one or a plurality of recess cavities 72 between a die head 14 adjacent to a first side 50 and the recessed bridge 112, as well as at least one or a plurality of second recess cavities 72 between a die head 14 adjacent to a second side 52 and the bridge recessed bridge 112. The recess cavities 72 are located on the opposite sides and are spaced and equal distance dimension from the centerline of the recessed bridge 112.

As depicted in FIG. 1 the die heads 14 extend downwardly from the lower surface of the cross bow bar support 12. The recess cavities 72 are disposed on the opposite or upper face of the cross bow bar support 12 interior to the die heads 14 and exterior relative to the recessed bridge 112. Each of the recess cavities 72 defines an interior wall 76 and an exterior wall 78. As may be seen in FIG. 1 moving from left to right along the cross bow bar support 12, a structural area 80 is located between the exterior wall 78 and the first side 50; the interior wall 76 and the recessed bridge 112 distal to the first side 50; the recessed bridge 112 and the interior wall 76 distal to the second side 52; and the exterior wall 78 and the second side 52. The recess cavities 72 in addition, each include a back wall 73 which functions as a hard stop for the repositionable die heads 16, when the repositionable die heads 16 are rotated upwardly or downwardly into an operative bending position, for either the reverse or forward bending configurations.

In some embodiments the mounting blocks 64 are substantially rectangular and cuboid in shape, and are sized for placement within each of the recess cavities 72. The mounting blocks 64 may have rounded edges and corners. One repositionable die head 16 is releasably attached to a flat exterior surface of each mounting block 64.

It should be noted that the mounting blocks 64 may have any geometric shape as desired including cubical, spherical, ovoid, hexagonal prism, or pentagonal prism to name a few of the many available shape options. Correspondingly, the shape selected for the plurality of recess cavities 72 should conform to the shape selected for the mounting blocks 64.

In at least one alternative embodiment, the exterior edges of the mounting blocks 64 are proximate to a respective interior wall 76 and exterior wall 78 of a recess cavity 72. A pin or shaft 74 may be engaged to each of the interior walls 76 and passes outwardly into a respective mounting block 64. A pin or shaft 74 may be engaged to each of the exterior walls 78 and passes inwardly into a respective mounting block 64. The pins or shafts 74 extend in a longitudinal direction which is substantially parallel to longitudinal axis 56. The pins or shafts 74 function as an axel for the repositioning and rotation of the mounting blocks 64 and repositionable die heads 16 in the upward or downward direction relative to the cross bow bar support 12 and longitudinal axis 56. The repositioning of the mounting blocks 64 and repositionable die heads 16 about the shaft or pins 74 is depicted by arrow 70.

Alternatively, the shaft or pins 74 may extend completely through a mounting block 64 being attached to an adjacent exterior wall 78 and interior wall 76. Alternatively, the shaft or pins 74 may only extend partially into a mounting block 64 from a respective adjacent exterior wall 78 or interior wall 76.

In at least one embodiment as shown in FIG. 1, the bending mandrel 28 is held in a stationary position and is engaged to a pipe to be reformed. The handle 22 is squeezed towards the frame 18 represented by arrow 86, which activates a ratchet mechanism 82 to displace the slide rod 20 in a forward direction as indicated by arrow 84. The displacement of the slide rod 20 in the direction of arrow 84 then moves the cross bow bar support 12 in the direction of arrow 84 whereupon either the pipe receiving recess 62 of the die heads 14 contact the pipe exclusively, or the pipe receiving recess 62 of both of the die heads 14 and the repositionable die heads 16 contact the pipe. Continued or repetitive movement of the handle 22 in the direction of arrow 86 advances the ratchet mechanism 82, the die heads 14, and repositionable die heads 16 if placed into the operative position, in the direction of arrow 84, placing pressure onto distal portions of the pipe, causing the interior portion of the pipe between the die heads 14 or repositionable die heads 16 to conform to the shape of the bending mandrel 28, bending the pipe to the desired angle without fracture or the placing a kink into the pipe.

At such time as a desired bend angle for the pipe is achieved, then the handle 22 may be moved from an at rest position in the direction of arrow 88 away from the frame 18 to release the ratchet mechanism 82 permitting the slide rod 20 and cross bow bar support 12 to be retracted in the direction of arrow 90 away from the bending mandrel 28 and bent pipe.

In a preferred embodiment, two die heads 14 are used on the cross bow bar support 12 to bend pipe. However the number of die heads 14 on the cross bow bar support 12 may vary at the discretion of an individual. It is anticipated that the number of die heads 14 used on the cross bow bar support 12 will be an even number for use as matching working pairs. It is anticipated that the number of die heads 14 on a cross bow bar support 12 may be 2, 4, 6, or 8 or more at the discretion of an individual, each of the respective die heads 14 having a plurality of faces including pipe receiving recesses 62.

In an alternative embodiment, at east two repositionable die heads 16 and at least two die heads 14 are used on the cross bow bar support 12 to bend pipe. However the number of die heads 14 or the number of repositionable die heads 16 on the cross bow bar support 12 may vary at the discretion of an individual. It is anticipated that the number of die heads 14 or repositionable die heads 16 used on the cross bow bar support 12 will each be an even number, for use as matched working pairs.

It is anticipated that the repositionable die heads 16 will be manipulated into a downward working configuration for use in the bending of a pipe having a smaller diameter. The repositionable die heads 16 are at a location which is proximate to the recessed bridge 112 and therefore relocate the pressure to be applied to the pipe to a more central location as opposed to at a more distal location on the pipe as would be provided by the die heads 14. With smaller diameter pipe, the placement of bending pressure at the distal ends of the pipe increase the risk of causing a kink or a deformation of the pipe proximate to the center. Therefore, the placement and use of the repositionable die heads 16 as positioned proximate to the center of the bending radius reduces the risk of imparting damage to the pipe during bending. In addition, the use of the repositionable die heads 16 as positioned proximate to the center of the bending radius permits an HVAC technician to form a bend having a tighter bending radius for the pipe as may be required in a particular application.

In certain embodiments, the use of both die heads 14 and repositionable die heads 16, enable an HVAC technician to spread the bending force to be applied to the pipe over an enlarged surface area, thereby reducing risk of deformation to the pipe.

In some embodiments each of the die heads 14, and repositionable die heads 16, may include one, two, three, four, five or more pipe receiving recess 62, where each of the pipe receiving recess 62 on either a die head 14, or a repositionable die head 16, may have the same or a different sized arcuate radius. The pipe receiving recess 62 of each of the die heads 14, or repositionable die heads 16, in contact with the pipe to receive a bend may be identical or may be non-symmetrical as required by a particular application. A single die head 14 disposed on each of the opposite sides of the bending mandrel 28, a single repositionable die head 16 disposed on each of the opposite sides of the bending mandrel 28, or both a single die head 14 and a single repositionable die head 16 disposed on the opposite sides of the bending mandrel 28, is contemplated as the most common configuration for the tubing bender 10, however other configurations may be used as necessary for a particular project when specific radius for a bend is to be formed into a pipe.

In other embodiments, a die head 14 may be used on one side of the bending mandrel 28, and a repositionable die head 16 and a die head 14 may be used on the opposite side of the bending mandrel 28, in order to impart a bend on a pipe having a different bending profile as required by a particular application.

In a preferred embodiment, the elements and components for the tubing bender 10 as identified herein are preferably formed of metallic material which is sufficiently sturdy to not fracture or fail during anticipated working conditions. It is also anticipated that the material selected for the components of the tubing bender 10 will be corrosive and rust resistant prolonging the useful working life for the tubing bender 10. Other sturdy materials may be selected for components of the tubing bender 10, including but not limited to the use of hard plastic, ceramic, composite, or hard rubber materials to name a few. It is anticipated that the materials selected for the tubing bender 10 will be of sufficiently durability to not fracture or fail when exposed to normal use in bending pipe over prolonged periods of time.

Figure 2:
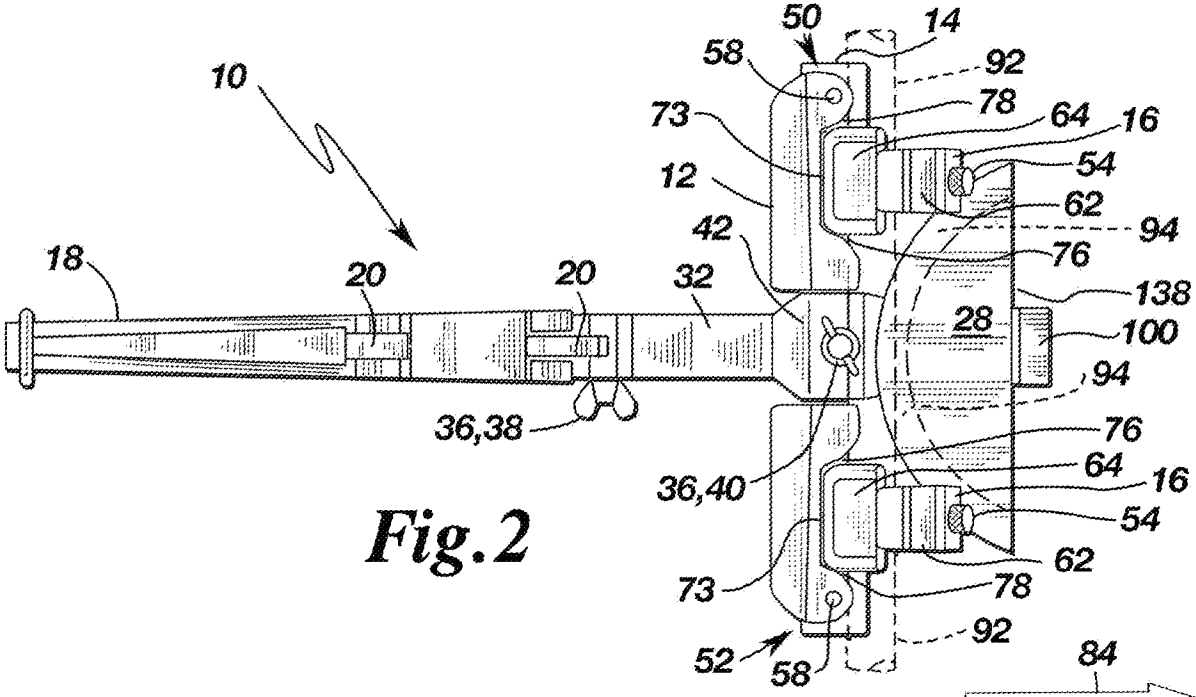
FIG. 2 is a top plan view of one alternative embodiment of the tube/pipe bending device.
Figure 3:
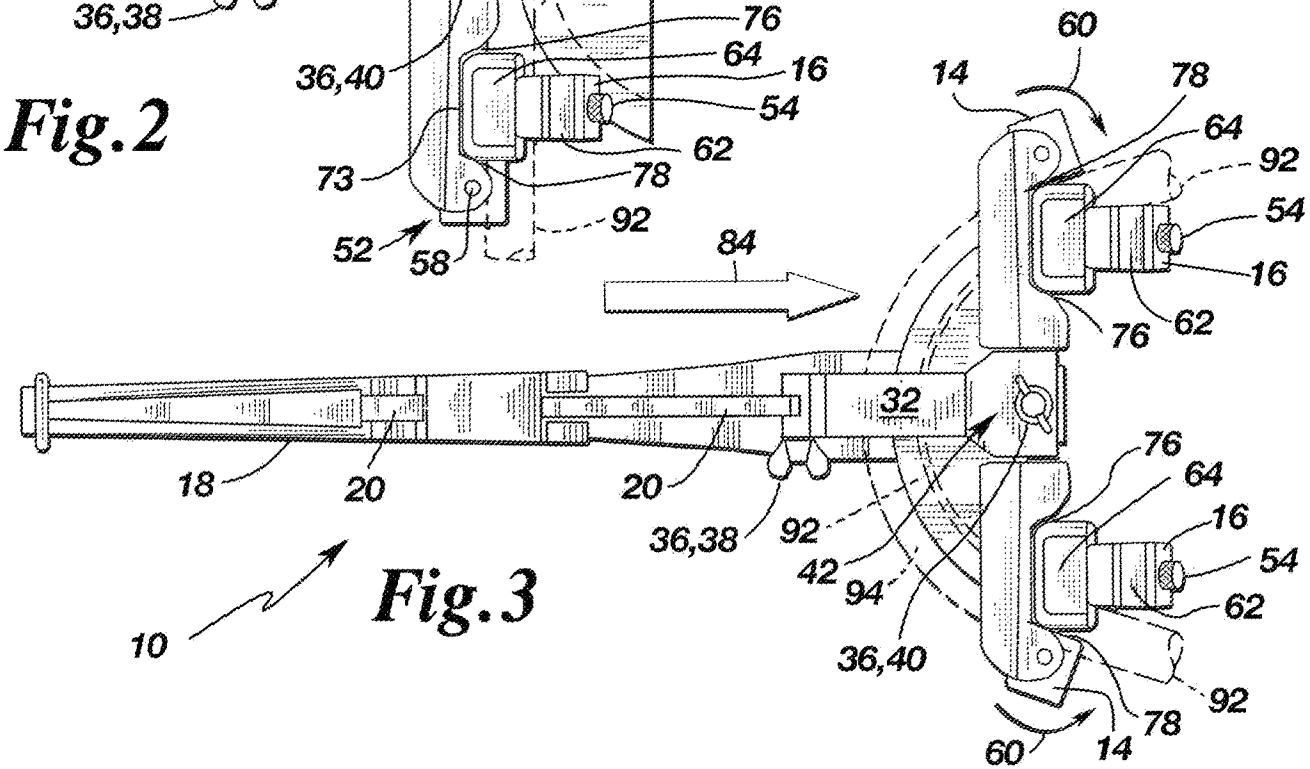
FIG. 3 is an alternative top plan view of one alternative embodiment of the tube/pipe bending device.

Referring to FIG. 2 and FIG. 3, alternative top plan views of the tubing bender 10 are shown. As may be seen in FIG. 2 and FIG. 3 the pipe 92 is identified by dashed line. The tubing bender 10 in FIG. 2 and FIG. 3 depict the reverse bend configuration. In both FIG. 2 and FIG. 3 the die heads 14 extend downwardly from the cross bow bar support 12 and are positioned for engagement to the pipe 92, and the repositionable die heads 16 are elevated and rotated above the cross bow bar support 12, in a non-interference and non-engaged position avoiding contact the pipe 92 while simultaneously permitting unobstructed advancement of the cross bow bar support 12 towards the bending mandrel 28.

As may be seen in FIG. 2 and FIG. 3 the tubing bender 10 includes the bending mandrel 28. The bending mandrel 28 in turn includes an arcuate pipe receiving channel 94. The arcuate pipe receiving channel 94 functions as bending surface for the pipe 92. The bending mandrel 28, including the pipe receiving channel 94, defines a desired curved bend radius or bend angle during the bending of the pipe 92. The tubing bender 10 and the bending mandrel 28 are constructed and arranged for fast and easy interchangeability to enable an HVAC technician to quickly replace a bending mandrel 28 for a substitute bending mandrel 28 having a different curved exterior bend radius or bend angle. In addition, the tubing bender 10 and the bending mandrel 28 are constructed and arranged for fast and easy interchangeability to enable an HVAC technician to quickly replace a bending mandrel 28 for a substitute bending mandrel 28 having a larger or smaller sized pipe receiving channel 94 to accommodate larger or smaller diameter pipes 92.

The interchangeable bending mandrels 28 will include a back mandrel wall 138 having a centrally positioned receiving aperture 104, having the identical dimensions as the first bracket vertical receiving aperture 34. Opposite to the back mandrel wall 138 will be located the pipe receiving channel 94. Each interchangeable bending mandrel 28 will include a different exterior bending radius and a different sized pipe receiving channel 94. Therefore, for the bending of pipe having a particular diameter size, one or more replaceable or interchangeable bending mandrels 28 may be selected dependent on the bend radius desired to accommodate a particular pipe diameter size. In addition, one or more interchangeable die heads 14 and interchangeable repositionable die heads 16 may be selected to match the size dimension selected for the pipe receiving channel 94 for the selected exterior bending radius for the bending mandrel 28.

In FIG. 2 the tubing bender 10 is placed into a pre-bending position, where the pipe 92 is disposed between the die heads 14 and the pipe receiving channel 94 of the bending mandrel 28. In the pre-bending configuration the pipe 92 may be repositioned in a perpendicular or normal direction relative to arrow 84 until such time as the portion of the pipe to receive the bend is centered with respect to, and aligned with the die heads 14 and the pipe receiving channel 94. In the pre-bending configuration the cross bow bar support 12 is retracted to an at rest position towards the frame 18, which is distal relative to the pipe receiving channel 94 and/or bending mandrel 28. In the pre-bending configuration the bending mandrel 28 is positioned away from the frame 18, and the cross bow bar support 12. In this pre-bending configuration the pipe receiving channel 94 is facing the die heads 14, cross bow bar support 12 and the frame 18.

To initiate pipe bending the handle 22 is repeatedly squeezed and released towards and away from the frame 18 to activate the ratchet mechanism 82 to advance the cross bow bar support 12 in the direction of arrow 84. As the cross bow bar support 12 is advanced in the direction of arrow 84, the pipe receiving recess 62 of the die heads 14 contacts the exterior surface of the pipe 92. The repositionable die heads 16 are elevated relative to the cross bow bar support 12 above the bending mandrel 28, and do not interfere with the movement of the cross bow bar support 12 in the direction of arrow 84. As additional movement of the cross bow bar support 12 occurs in direction of arrow 84, the die heads 14 as engaged to the pipe 92 revolve, pivot, or rotate about a respective die head axis 58, and slide along the exterior length of the pipe 92 away from the center of the bend. The pipe receiving recess 62 remain in contact with exterior surface of pipe 92 as slide rod 20 and cross bow bar support 12 are advanced towards and past the forward portion of bending mandrel 28.

As the cross bow bar support 12 is advanced in the direction of arrow 84, the pipe 92 is forced into the pipe receiving channel 94, and conforms to curved bend radius or bend angle as desired for the bending mandrel 28. The pivoting or rotation of the die heads 14 about die head axis 58 during the sliding of the exterior surface of pipe 92 past the die heads 14 is shown by arrow 60. The sliding of the exterior surface of the pipe 92 past the die heads 14 will occur until a desired bend angle is obtained.

The movement of cross bow bar support 12 in direction of arrow 84 passes the main body of the cross bow bar support 12 in a plane above the bending mandrel 28, and advancement of the cross bow bar support 12 occurs until such time as a desired bend angle or radius for the pipe 92 has been obtained. During the advancement of the cross bow bar support 12 in direction of arrow 84, the second support bracket 26, as releasably engaged to the frame 18, and as releasable engaged to the bending mandrel 28, remain in a fixed or stationary position. During advancement of the cross bow bar support 12, where the cross bow bar support 12 passes over the top of the bending mandrel 28, while maintaining contact between the die heads 14 and/or repositionable die heads 16 with the pipe 92, as the pipe 92 is disposed in the pipe receiving channel 94.

The cross bow bar support 12 is the portion of the tubing bender 10 transferring linear motion and pressure to the exterior surface of the pipe 92 to accomplish the tube bending against the bending mandrel 28, which remains in a stationary position relative to the frame 18.

As may be seen in FIG. 2 and FIG. 3 the relative positioning and shape of the recess cavities 72 as well as the mounting blocks 64 is shown in additional detail. Further, the top of the vertical arm 100 of the second support bracket 26 is shown as positioned exterior to the back mandrel wall 138.

Figure 4:
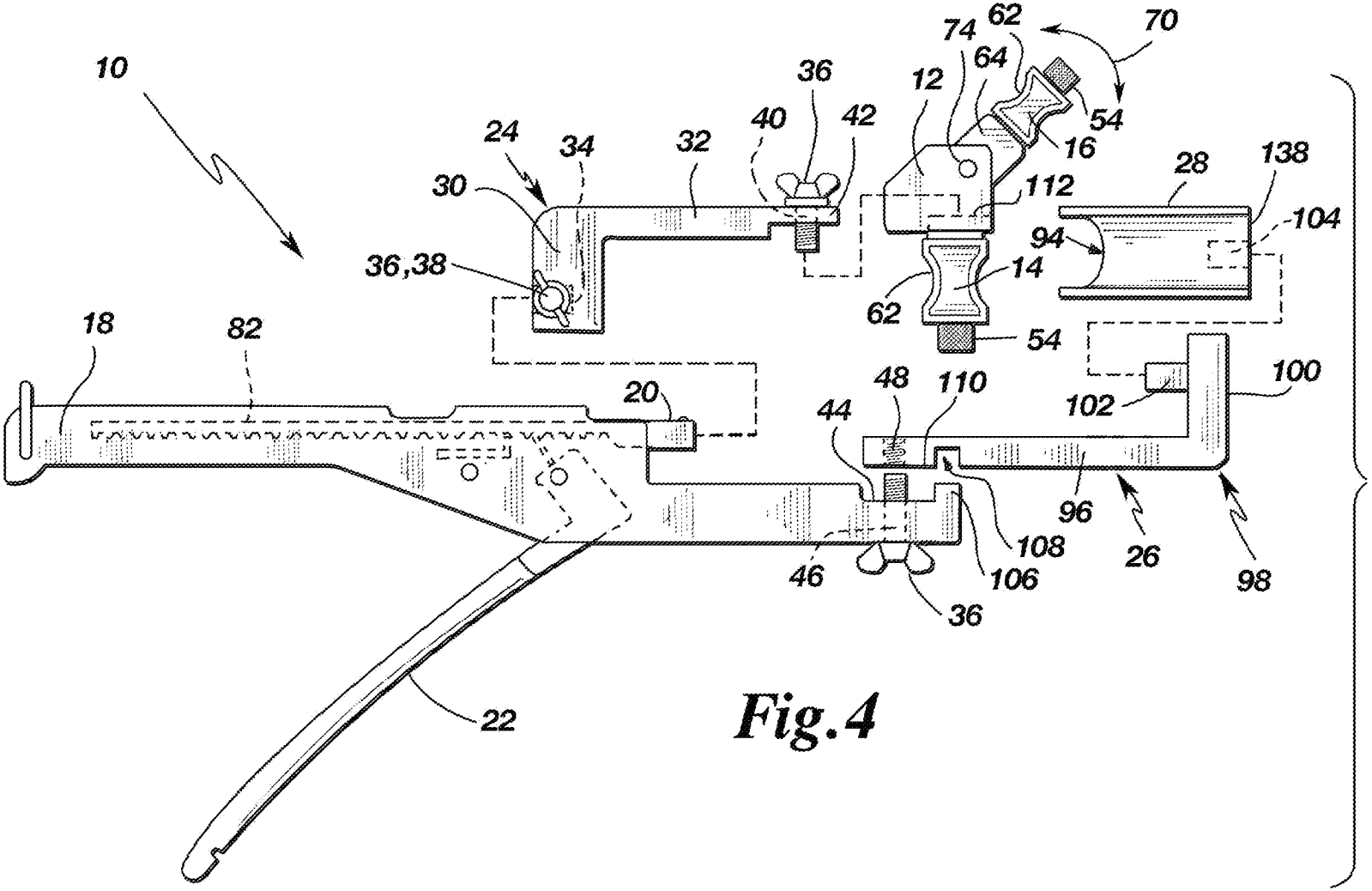
FIG. 4 is a right side elevation and exploded view of one alternative configuration of the tube/pipe bending device.
Figures 5, 6:
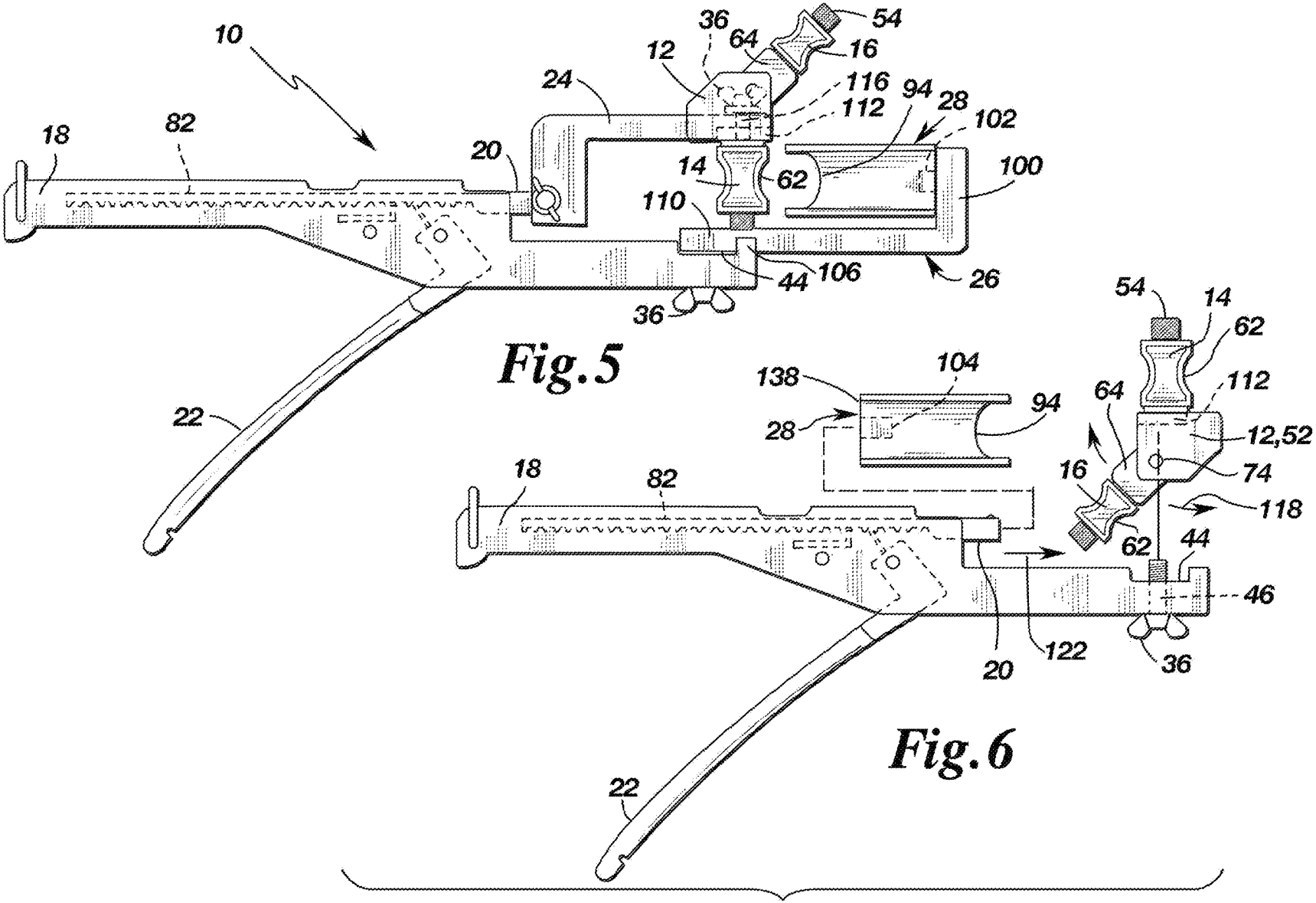
FIG. 5 is a right side elevation view of one alternative configuration of the tube/pipe bending device.
FIG. 6 is a right side elevation and exploded view of one alternative configuration of the tube/pipe bending device.

As may be seen in FIG. 4 and FIG. 5, in at least one embodiment, the second support bracket 26 includes a horizontal arm 96 having a distal end 98 and a vertical arm 100 extending upwardly from the distal end 98. The second bracket vertical attachment aperture 48 is located proximate to the end of horizontal arm 96 which releasably engages the frame notch 44 of the frame 18. The horizontal arm 96, on the lower surface proximate to the end of second support bracket 26 releasably engaging the frame 18, includes a support beam channel 108. The support beam channel 108 receives the support beam 106 of the exterior end of the frame notch 44. The positioning of the support beam 106 into the support beam channel 108 aligns the second bracket vertical attachment aperture 48 to the second bracket vertical affixation aperture 46 for receipt of the affixation member 36. In addition, the interior portion of the second support bracket 26 between the support beam channel 108 and the end interior wall of horizontal arm 96 establishes a second bracket platform 110 which is disposed in the frame notch 44 during releasable engagement between the second support bracket 26 and the frame 18.

The vertical arm 100 of the second support bracket 26 includes an inwardly extending mandrel post 102. The mandrel post 102 slidably enters the receiving aperture 104 following the alignment of the bending mandrel 28 to the vertical arm 100. A portion of the back mandrel wall 138 is in contact with the vertical arm 100 during insertion of the mandrel post 102 into the receiving aperture 104, providing support between the bending mandrel 28 and the second support bracket 26. The engagement of the back mandrel wall 138 to the interior of the vertical arm 100 minimizes undesirable repositioning or misalignment of the bending mandrel 28 relative to the vertical arm 100 as the cross bow bar support 12 is advanced during the bending of pipe.

In the reverse bending configuration, the horizontal arm 96 of the second support bracket 26 is releasably coupled to the frame notch 44 of the frame 18. In addition the bending mandrel 28 is releasably coupled to the mandrel post 102 on the interior wall of the vertical arm 100 upon the insertion of the mandrel post 102 into the receiving aperture 104.

As may also be seen in FIG. 4 and FIG. 5, the first bracket vertical receiving aperture 34 of the first support bracket 24 releasably receives the slide rod 20 of the frame 18. Upon the positioning of the slide rod 20 within the first bracket vertical receiving aperture 34 the affixation member 36 may be tightened to releasable secure the first support bracket 24 to the frame 18.

In at least one alternative embodiment, the horizontal portion 32 of the first support bracket 24, at the forward or distal end, includes the central portion 42 which has a lower surface similar to a notch. The central portion 42 includes the first bracket vertical affixation aperture 40. The central portion 42 is positioned above a recessed bridge 112 which extends between the two inner structural areas 80 which are proximate to the center of the cross bow bar support 12. The transition between the recessed bridge 112 and the two inner structural areas 80 includes a vertical positioning wall 114. (FIG. 1)

A bridge affixation aperture 116 is centrally positioned, and traverses, the recessed bridge 112 for alignment with the first bracket vertical affixation aperture 40, and receives an affixation member 36. The central portion 42 as disposed above and as in contact with the recessed bridge 112 is the location for releasable attachment of the first support bracket 24 to the cross bow bar support 12, to provide the reverse bend configuration of the tubing bender 10.

As may be seen in FIG. 5 the tubing bender 10 is shown in an assembled reverse bend configuration. In FIG. 5 the repositionable die heads 16 have been elevated relative to the cross bow bar support 12 into a non-operative or non-engaged position.

As may be seen in FIG. 6 the frame 18, ratchet mechanism 82, handle 22 and slide rod 20 operate in an identical manner as previously described relative to FIGS. 1-5.

In the alternative embodiment as shown in FIG. 6, the tubing bender 10 has been transitioned into a forward bend configuration. In the forward bend configuration the bending mandrel 28 has been moved to a different location on the tubing bender 10, and the direction which the bending mandrel 28 faces has been reversed relative to frame 18.

In the reverse bend configuration as shown in FIGS. 1-5, the bending mandrel 28 and the pipe receiving channel 94 face in a rearward direction toward the frame 18 and the handle 22 and the bending mandrel 28 is stationary relative to the frame 18 and handle 22 during the bending of pipe.

In FIG. 6 the bending mandrel 28 and the pipe receiving channel 94, as repositioned to a different location, are facing in the opposite direction away from the frame 18 and the handle 22. In the forward bend configuration for the tubing bender 10 the slide rod 20 is releasably engaged to the receiving aperture 104. The ratchet mechanism 82 and the slide rod 20 advance the bending mandrel 28 in a forward direction towards the stationary cross bow bar support 12.

In order to transition the tubing bender 10 from the reverse bend configuration into the forward bend configuration an individual will untighten the affixation member 36 from the central portion 42 and the recessed bridge 112 separating the cross bow bar support 12 from the first support bracket 24. The individual will next untighten the affixation member 36 from the first support bracket 24, and move the first support bracket 24 in a forward direction to separate the first bracket vertical receiving aperture 34 from the slide rod 20. Next, an individual will move the bending mandrel 28 in a rearward direction separating the receiving aperture 104 from the mandrel post 102. Then the individual will untighten the affixation member 36 from the second bracket vertical affixation aperture 46 and the second bracket vertical attachment aperture 48 permitting the removal of the second bracket platform 110 from the frame notch 44 and the support beam 106 from the support beam channel 108, separating the second support bracket 26 from the frame 18.

In order to re-assemble the tubing bender 10 into a forward bending configuration as may be seen in FIG. 6, an individual will reposition the bending mandrel 28 by rotation of 180 degrees and position the receiving aperture 104 for alignment with the slide rod 20, whereupon the bending mandrel 28 is moved rearwardly inserting the slide rod 20 into the receiving aperture 104. The pipe receiving channel 94 of the bending mandrel 28 is now facing in the forward bend position for the tubing bender 10.

Next, an individual will reposition the cross bow bar support 12 by changing the direction of the elevation and descent of the repositionable die heads 16 from being forward relative to the cross bow bar support 12 (reverse bending configuration) to a location rearwardly relative to the cross bow bar support 12 (forward bending configuration). To accomplish the reversal of the direction of the repositionable die heads 16, the cross bow bar support 12 is rotated about its longitudinal axis 180 degrees, so that the repositionable die heads 16 in FIG. 6 are disposed rearwardly relative to the tubing bender 10.

Figures 7, 8, 9, 10:
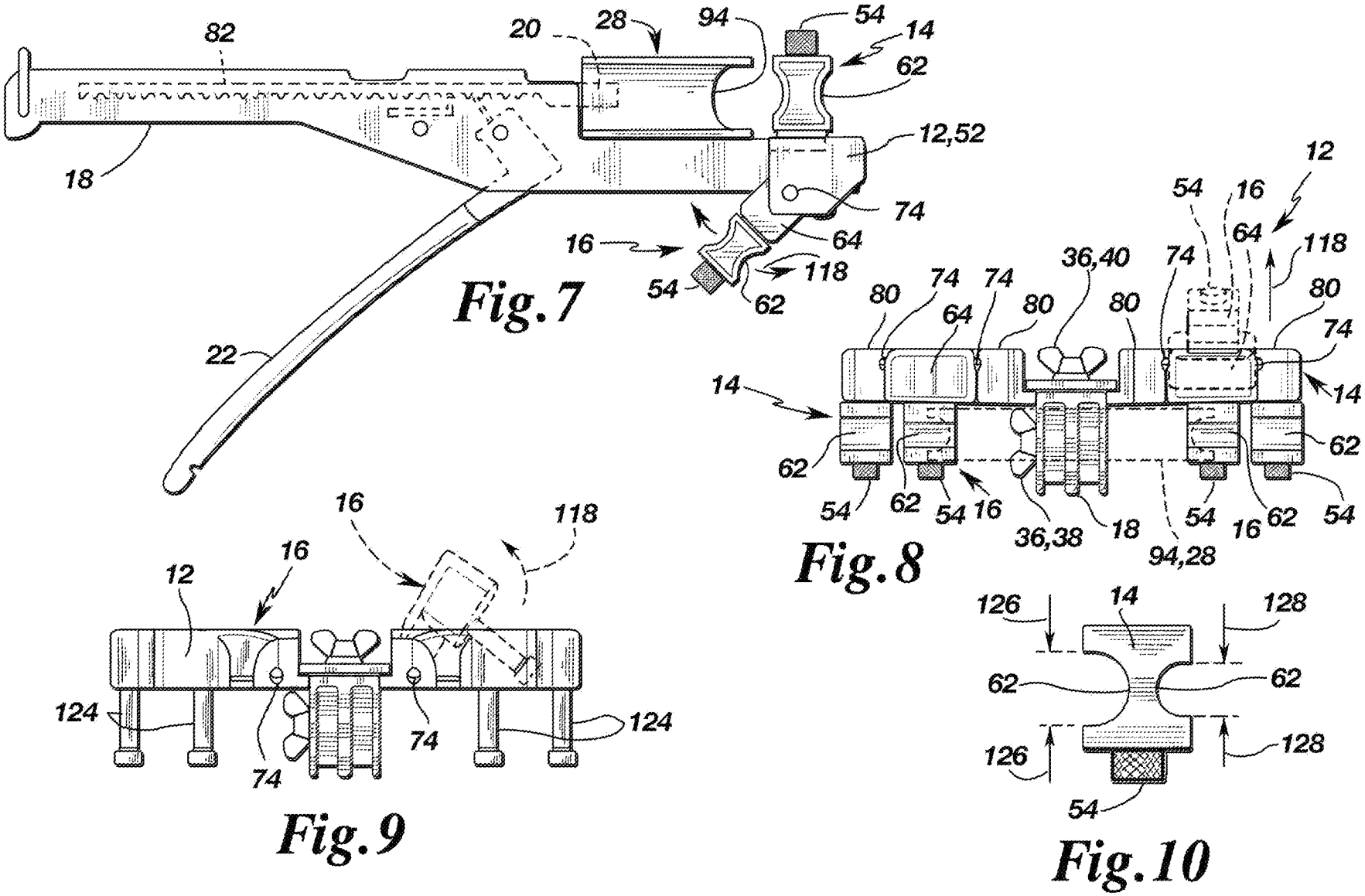
FIG. 7 is a right side elevation view of one alternative configuration of the tube/pipe bending device.
FIG. 8 is a front elevation view of one alternative configuration of the tube/pipe bending device.
FIG. 9 is a front elevation view of one alternative configuration of the tube/pipe bending device.
FIG. 10 is a partial detail side elevation view of a die head of one alternative embodiment of the tube/pipe bending device.

In the alternative embodiment shown in FIG. 6 the cross bow bar support 12 is revolved into an upside-down position where the die head 14 is facing in the upward direction and the repositionable die heads 16 are disposed rearwardly and are repositionable in a downward and upward direction relative to the longitudinal axis 56 of FIG. 1 as indicated by arrow 118. In both the reverse bending configuration of FIGS. 1-5, and the forward bending configuration as shown in FIGS. 6-7, for the tubing bender 10, the first side 50 remains on the left and the second side 52 remains on the right with respect to the cross bow bar support 12.

In the forward bend configuration for tubing bender 10, the recessed bridge 112 has been rotated 180 degrees into an upside-down position with the top surface of recessed bridge 112 facing downwardly for placement into the frame notch 44. The affixation member 36 may then pass upwardly through the second bracket vertical affixation aperture 46 and the bridge affixation aperture 116 to secure the cross bow bar support 12 to the frame 18 in the forward bend configuration for the tubing bender 10.

In the alternative embodiment shown in FIG. 6 the receiving aperture 104 is positioned onto the forward end of slide rod 20, and the advancement of the ratchet mechanism 82 moves the bending mandrel 28 in a forward direction away from the frame 18 and handle 22. In the alternative embodiment shown in FIG. 6 an affixation member 36 is not used to releasably attach the bending mandrel 28 to the slide rod 20.

In the alternative embodiment shown in FIG. 6 the pipe 92 is disposed on the same plane as, and is located between the pipe receiving channel 94 and the upwardly extending pipe receiving recess 62 of either the plurality of die heads 14, or the plurality of die heads 14 and the plurality of repositionable die heads 16, dependent on the diameter of the pipe to receive bending. In order to accomplish pipe bending an individual will grasp the handle 22 as earlier described to activate the ratchet mechanism 82 to advance the slide rod 20 in the forward direction as indicated by arrow 122 of FIG. 6.

It should be noted that in at least one embodiment, that the dimensions for the mandrel post 102, receiving aperture 104 and the slide rod 20 are identical for the convenient disassembly and reassembly of the tubing bender 10 between a reverse bending and a forward bending configuration. In addition, the uniformity of the size dimension between the mandrel post 102, receiving aperture 104, and slide rod 20 provides for the convenient substitution of one bending mandrel 28 for another bending mandrel 28 having a different bending radius dimension, or a different size dimension for the pipe receiving channel 94. The reconfiguration of the tubing bender 10 and the interchangeability of the bending mandrel 28 may also occur simultaneously with the substitution of different sized die heads 14 and repositionable die heads 16 for die heads 14 and repositionable die heads 16 having an alternative size for the pipe receiving recess 62.

In the alternative embodiment shown in FIG. 7 the cross bow bar support 12 has been releasable secured to the frame 18 and the bending mandrel 28 has been releasably secured to the slide rod 20 to provide the tubing bender 10 in a forward bending configuration. As may be seen in FIG. 7, in an operative configuration, the repositionable die heads 16 may be repositioned in the upward direction of arrow 118, for alignment with the die heads 14 for bending pipe 92 having a smaller diameter.

In the alternative embodiment shown in FIG. 6 and FIG. 7 the operation, repositioning, and/or revolution of the die heads 14 and the repositionable die heads 16 is identical to the operation, repositioning, and/or revolution of the die heads 14 and the repositionable die heads 16 as earlier described with respect to FIGS. 1-5, with the exception that the repositionable die heads 16 are repositioned in a downward direction and location in a non-operative position during the bending of pipe 92 in a forward direction, as opposed to being repositioned in an upward position and location during the bending of pipe 92 in a reverse direction.

In a preferred embodiment, the body of the cross bow bar support 12 is below a plane established by the bending mandrel 28, pipe 92 and die heads 14, or die heads 14 and repositionable die heads 16 during bending of pipe 92 in the forward bending direction. Likewise the body of the cross bow bar support 12 is above a plane established by the bending mandrel 28, pipe 92 and die heads 14, or die heads 14 and repositionable die heads 16 during bending of pipe 92 in the reverse bending direction. It should be noted that the body of the cross bow bar support 12 does not contact or interfere with the bending of the pipe 92 during either of the forward or reverse pipe bending directions.

In a preferred embodiment, the repositionable die heads 16 as rotated into in a non-operative position are below a plane established by the bending mandrel 28, pipe 92 and die heads 14, during bending of pipe 92 in the forward bending direction. Likewise the repositionable die heads 16 as rotated into in a non-operative position are above a plane established by the bending mandrel 28, pipe 92 and die heads 14, during bending of pipe 92 in the reverse bending direction. It should be noted that the repositionable die heads 16 do not contact or interfere with the bending of the pipe 92 during either of the forward or reverse pipe bending procedures when the repositionable die heads 16 are repositioned into a non-operative location.

In the alternative embodiment shown in FIG. 8, a front elevation view of the cross bow bar support 12 and bending mandrel 28 is shown in the reverse bending configuration.

In the alternative embodiment shown in FIG. 8, the die heads 14 and repositionable die heads 16 are shown as extending downwardly in a reverse bending configuration as previously described relative to FIGS. 1-5. Both of the die heads 14 and repositionable die heads 16 are disposed downwardly for bending of a pipe 92 having a smaller diameter dimension. In FIG. 8, the pipe receiving channel 94 and bending mandrel 28 are shown in phantom line in the same plane as the die heads 14 and repositionable die heads 16 below the cross bow bar support 12 in the reverse bending configuration.

In FIG. 8 one of the repositionable die heads 16 is shown in phantom line a non-operational position which has been rotated in an upward direction about the shaft or pin 74.

In the alternative embodiment shown in FIG. 8, the shaft or pins 74 extend in a horizontal or longitudinal direction relative to the cross bow bar support 12, and the shaft or pins 74 are parallel to the longitudinal axis 56 of FIG. 1. The shaft or pins 74 are aligned between each of the repositionable die heads 16 which in turn aligns each of the pipe receiving recess 62 of the die heads 14 and repositionable die heads 16 relative to each other for the receipt of the curved surface of a pipe 92.

In the alternative embodiment shown in FIG. 9 the die heads 14 and repositionable die heads 16 on the cross bow bar support 12 have been replaced with cylindrical posts 124. The posts 124 may be releasably or interchangeably engaged to the cross bow bar support 12.

In the alternative embodiment shown in FIG. 9, the die heads 14 may be eliminated and the a plurality of exterior posts 124 may be directly and releasably secured proximate to the opposite ends of the cross bow bar support 12 by post attachment devices 134.

Figure 12:
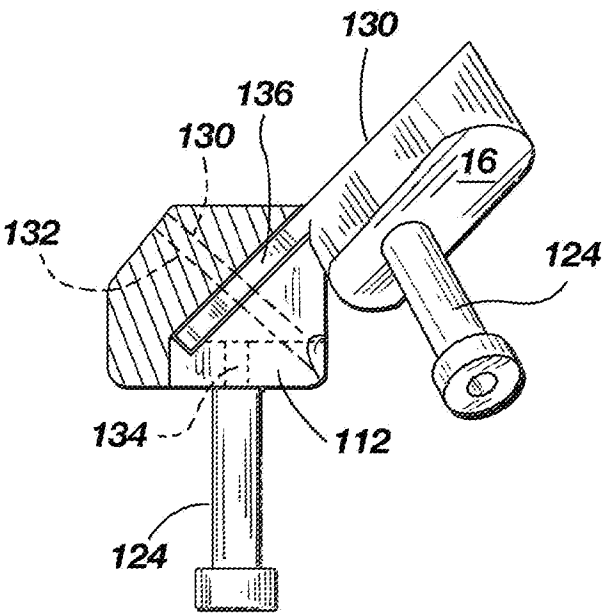
FIG. 12 is a detail partial cross sectional side view of one alternative embodiment of the cross bow bar support taken along the line 11-11 of FIG. 11.
Figure 11:
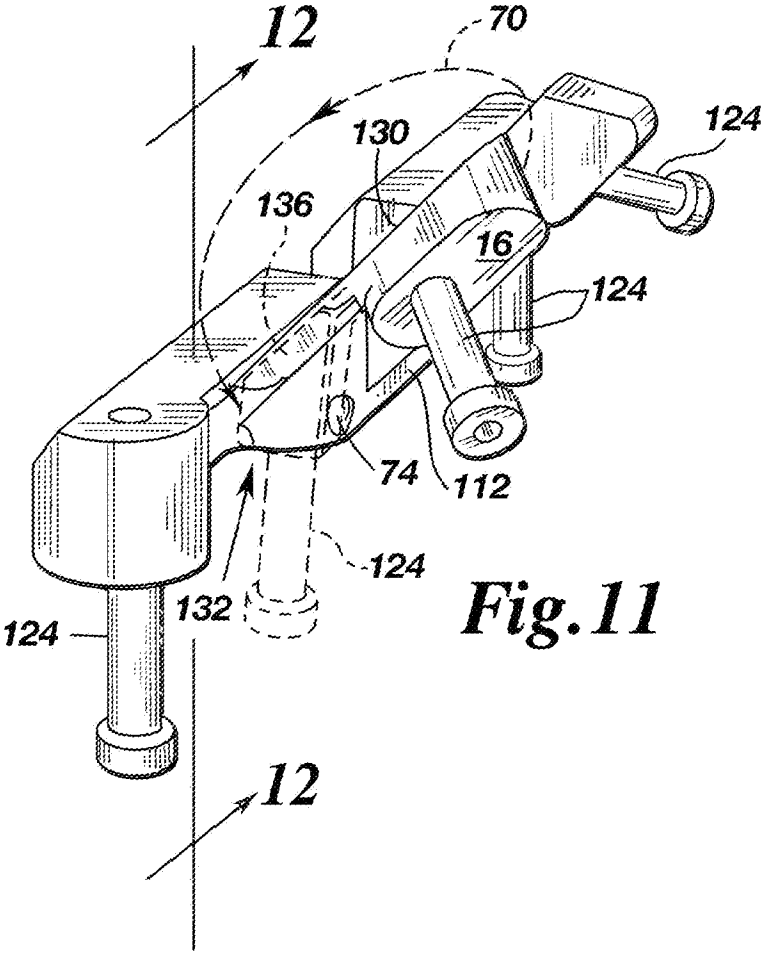
FIG. 11 is a detail front isometric perspective view of one alternative for the cross bow bar support of one embodiment of the tube/pipe bending device.

The mounting blocks 64, the plurality of repositionable die heads 16, and the cross bow bar support 12 have an alternative shape proximate to the center of the cross bow bar support 12 as shown in FIGS. 9, 11 and 12. The repositionable die heads 16 have been replaced with a plurality of exterior posts 124 which are pivotally secured or swing relative to the cross bow bar support 12 by shaft or pins 74 which extend in a direction which is normal or perpendicular relative to the direction of longitudinal axis 56 of FIG. 1. The repositionable posts 124 of FIG. 9, swing or are repositionable in an upward non-operational configuration in reverse bending configuration. In addition, the repositionable posts 124 of FIG. 9, swing or are repositionable in a downward non-operational configuration in forward bending configuration.

In the alternative embodiment of FIG. 10, a partial detail side elevation view of a die head 14 is shown. As may be seen in FIG. 10, arrow 126 identifies a pipe receiving recess 62 having a larger radius dimension for engagement to a pipe 92 having a larger diameter as compared to arrow 128 which identifies a pipe receiving recess 62 having a smaller radius dimension for engagement to a pipe 92 having a smaller diameter. As earlier described the die head 14 may be rotated about die head attachment 54 so that either side of the die head 14 having the desired radius for pipe receiving recess 62 is disposed into the operative position for engagement to the pipe 92 during a pipe bending operation.

Returning to the alternative embodiment of FIGS. 9, and 12, one alternative shape for the repositionable posts 124 and the mounting blocks 64 is shown. In FIG. 11 and FIG. 12, each of the repositionable mounting blocks 64 has an angular face 130 for flush positioning adjacent to an angular wall 132. The angular wall 132 has a wider width dimension proximate to the top of the cross bow bar support 12, and a narrower width dimension proximate to the bottom of the cross bow bar support 12, when the cross bow bar support 12 is disposed in the operative position in the reverse bending configuration. The angular wall 132 has a wider width dimension proximate to the bottom of the cross bow bar support 12, and a narrower width dimension proximate to the top of the cross bow bar support 12, when the cross bow bar support 12 is disposed in the operative position in the forward bending configuration.

The angular face 130 has a wider width dimension proximate to the bottom of the repositionable mounting blocks 64, and a narrower width dimension proximate to the top of the repositionable mounting blocks 64, when the repositionable mounting blocks 64 is disposed in the operative position in the reverse bending configuration. The angular face 130 has a wider width dimension proximate to the top of the repositionable mounting blocks 64, and a narrower width dimension proximate to the bottom of the repositionable mounting blocks 64, when the repositionable post 24 is disposed in the operative position in the forward bending configuration.

In the alternative embodiment of FIG. 11 and FIG. 12, the recess cavities 72 extend outwardly an equal distance on opposite sides of the recessed bridge 112, and have an increased length dimension as compared to the embodiments described and shown in FIGS. 1-8. The approximate angle for the angular faces 130 and angular walls 132 is either 45 degrees or 135 degrees depending upon the configuration of the tubing bender 10. It should be noted that the approximate relative angles for the angular faces 130 and angular walls 132 will be interchangeable and depend on the configuration of the tubing bender 10 and cross bow bar support 12 during the pipe bending operations.

Each of the repositionable mounting blocks 64 for the alternative embodiment of FIG. 9 and FIGS. 11-12, includes an interior angular extension 136. The angular extension 136 provides the structure and the location for the shaft or pin 74 to attach the repositionable posts 124 and repositionable mounting blocks 64 into the recess cavities 72 of the cross bow bar support 12.

In the reverse bending configuration, to dispose the repositionable posts 124 into a non-operative position, the exterior portion of the repositionable mounting blocks 64 are pushed upwardly in a direction opposite to arrow 70 in FIG. 11. During rotation of the repositionable mounting blocks 64 relative to the recess cavities 72 the angular face 130 will slide upwardly and outwardly relative to the angular walls 132 until the repositionable mounting blocks 64 and repositionable posts 124 have been elevated relative to the cross bow bar support 12 into a non-operative and non-interference position. Conversely, in the reverse bending configuration, to dispose the repositionable mounting blocks 64 into an operative position, the exterior portion of the repositionable mounting blocks 64 are pushed downwardly in the direction of arrow 70 in FIG. 11. During rotation of the repositionable mounting blocks 64 relative to the recess cavities 72 the angular faces 130 will slide downwardly and inwardly relative to the angular walls 132 until the repositionable posts 124 descend relative to the cross bow bar support 12 into an operative position.

In the forward bending configuration, to dispose the repositionable mounting blocks 64 into a non-operative position, the exterior portion of the repositionable mounting blocks 64 are pushed downwardly as shown by arrow 118. During repositioning of the repositionable mounting blocks 64 relative to the recess cavities 72 the angular faces 130 will slide downwardly and outwardly relative to the angular walls 132 until the repositionable posts 124 have descended relative to the cross bow bar support 12, into a non-operative and non-interference position. Conversely, in the forward bending configuration, to dispose the repositionable mounting blocks 64 into an operative position, the exterior portion of the repositionable mounting blocks 64 are pushed upwardly as shown by arrow 118. During repositioning of the repositionable mounting blocks 64 relative to the recess cavities 72 the angular faces 130 will slide upwardly and inwardly relative to the angular walls 132 until the repositionable posts 124 are elevated relative to the cross bow bar support 12 into an operative position.

In the alternative embodiments as depicted in FIGS. 9, 11, and 12 the shafts or pins 74 have been shown in a normal direction relative to longitudinal axis 56 and positioned inwardly towards and proximate to the recessed bridge 112 on opposite sides of the cross bow bar support 12. In an alternative embodiment it is anticipated that the location of the normally disposed shafts or pins 74 for the embodiment depicted in FIGS. 9, 11, and 12 may be relocated. It is anticipated that in an alternative embodiment that the alternatively normally disposed shafts or pins 74 may be moved to a position opposite to the recessed bridge 112 and may be located proximate to the end of the first side 30 or the end of the second side 52 of the cross bow bar support 12.

In the embodiments as depicted in FIGS. 9, 11, and 12 the repositionable mounting blocks 64 pivot upwardly, inwardly and toward the recessed bridge 112 into the non-operative position in the reverse bending configuration. Alternatively, in FIGS. 9, 11, and 12 the repositionable mounting blocks 64 pivot downwardly, outwardly and away from the recessed bridge 112 into the operative position in the reverse bending configuration.

Alternatively, in some embodiments, the repositionable mounting blocks 64 pivot downwardly, outwardly and toward the recessed bridge 112 into the non-operative position in the forward bending configuration. Alternatively, the repositionable mounting blocks 64 pivot upwardly, outwardly and away from the recessed bridge 112 into the operative position in the forward bending configuration.

Alternatively, in some embodiments, the repositionable mounting blocks 64 pivot upwardly, outwardly and away from the recessed bridge 112 into the non-operative position in the reverse bending configuration, when the shafts or pins 74 are disposed outwardly towards the first end 50 or second end 52. Alternatively, the repositionable mounting blocks 64 pivot downwardly, inwardly and toward the recessed bridge 112 into the operative position in the reverse bending configuration when the shafts or pins 74 are disposed outwardly towards the first end 50 or second end 52.

Alternatively, in some embodiments, the repositionable mounting blocks 64 pivot downwardly, outwardly and away from the recessed bridge 112 into the non-operative position in the forward bending configuration when the shafts or pins 74 are disposed outwardly towards the first end 50 or second end 52. Alternatively, the repositionable mounting blocks 64 pivot upwardly, inwardly and toward the recessed bridge 112 into the operative position in the forward bending configuration when the shafts or pins 74 are disposed outwardly towards the first end 50 or second end 52.

In alternative embodiments, the ratchet mechanism 82 may be replaced with the use of a hydraulic device to impart motion onto the slide rod 20 during tube bending operations.

In an alternative embodiment, a tubing bender 10 may use a hydraulic style crossbow design bender wherein the compressing force from a hand is transmitted mechanically into a hydraulic pump which replaces a ratchet mechanism 82. The hydraulic force is then transmitted through a hydraulic fluid typically oil into a piston which transmits into a sliding force pushing slide rod 20 and the releasably attached bending mandrel 28 against the tube and cross bow bar support 12, allowing for the tubing to be formed into any bend from a zero to nearly 110 degree bend. Alternatively, the hydraulic force may transmit a sliding movement to a slide rod 20 having a releasable bracket which is releasably holding the cross bow bar support 12 against the tube and the bending mandrel 28, allowing for the tubing to be formed into any bend from a zero to nearly 110 degree bend.

In some embodiments, the pipe receiving recess 62 of the die heads 14, repositionable die heads 16, and pipe receiving channel 94 have appropriate radius dimensions to accommodate tubing or pipe diameter sizes of 3/16 inch, 1/4 inch, 5/16 inch, 3/8 inch, 1/2 inch, 5/8 inch, 3/4 inch, 7/8 inch, 1 1/8 inch, 1 3/8 inch, and/or 1 5/8 inch to name a few of the many different sizes of pipe.

In a first embodiment, the tubing bender device includes a frame having a handle, a ratchet mechanism engaged to a slide rod and the handle, and a frame notch proximate to an outer end of the frame; the frame having a first bending configuration further comprising a bending mandrel, the bending mandrel having a first bracket receiving aperture releasably engaged to the slide rod, and the frame having a cross bow bar support releasably engaged to the frame notch, the cross bow bar support comprising a plurality of die heads releasably engaged to the cross bow bar support, the die heads having a degree of revolution relative to the cross bow bar support, and a plurality of repositionable die heads releasably engaged to the cross bow bar support, the repositionable die heads having the degree of revolution relative to said cross bow bar support and a degree of rotation relative to the cross bow bar support, each of the die heads having at least one die head pipe receiving recess having a radius dimension, and each of the repositionable die heads having at least one repositionable die head pipe receiving recess having a radius dimension different from the radius dimension of the die head pipe receiving recess, wherein the die heads or the die heads and the repositionable die heads are aligned relative to the bending mandrel in an first configuration operative position, the die heads or the die heads and the repositionable die heads and the bending mandrel being constructed and arranged for bending a pipe in a first bending direction, and further wherein the repositionable die heads are rotated downwardly below the cross bow bar support in a first configuration non-operative position; and the frame having a second bending configuration comprising a first support bracket releasably engaged to the slide rod, the cross bow bar support being releasably engaged to the first support bracket, a second support bracket releasably engaged to the frame notch, the bending mandrel being releasably engaged to the second support bracket, wherein the die heads or the die heads and the repositionable die heads are aligned relative to the bending mandrel in an second configuration operative position, the die heads or the die heads and the repositionable die heads and the bending mandrel being constructed and arranged for bending the pipe in a second bending direction, the second bending direction being opposite to the first bending direction, wherein the repositionable die heads are rotated upwardly above the cross bow bar support in a second configuration non-operative position.

In a second alternative embodiment according to the first embodiment, the die heads and the repositionable die heads revolve in a clockwise or counter clockwise direction.

In a third alternative embodiment according to the second embodiment, the die heads and the repositionable die heads are releasably secured to the cross bow bar support by a die head attachment wherein the die heads or the repositionable die heads may be interchangeably replaced with substitute die heads or substitute repositionable die heads having the die head pipe receiving recess or the repositionable die head pipe receiving recess of a different size.

In a fourth alternative embodiment according to the third embodiment, the cross bow bar support has a center and at least one of the repositionable die heads is positioned on one side of the center and at least one of the repositionable die heads is positioned on an opposite side of the center.

In a fifth alternative embodiment according to the fourth embodiment, the die heads are positioned on the cross bow bar support exterior to the repositionable die heads.

In a sixth alternative embodiment according to the fifth embodiment, the cross bow bar support has a plurality of mounting blocks wherein one of the repositionable die heads is releasably engaged to each of the mounting blocks.

In a seventh alternative embodiment according to the sixth embodiment, the cross bow bar support defines a longitudinal axis.

In an eighth alternative embodiment according to the seventh embodiment, a shaft rotatably connects each mounting block to the cross bow bar support.

In a ninth alternative embodiment according to the eighth embodiment, each of the shafts establishes a longitudinal axis of rotation which is substantially parallel to the longitudinal axis.

In a tenth alternative embodiment according to the ninth embodiment, the bending mandrel has a pipe receiving channel and the pipe receiving channel is positioned in a direction away from the slide rod in the first configuration operative position and the first configuration non-operative position.

In an eleventh alternative embodiment according to the tenth embodiment, the pipe receiving channel is positioned in a direction towards the slide rod in the second configuration operative position and the second configuration non-operative position.

In a twelfth alternative embodiment according to the eleventh embodiment, the pipe receiving channel and the die heads engage a pipe in the first configuration non-operative position.

In a thirteenth alternative embodiment according to the twelfth embodiment, the pipe receiving channel, the die heads and the repositionable die heads engage the pipe in the first configuration operative position.

In a fourteenth alternative embodiment according to the thirteenth embodiment, the pipe receiving channel and the die heads engage the pipe in the second configuration non-operative position.

In a fifteenth alternative embodiment according to the fourteenth embodiment, the pipe receiving channel, the die heads and the repositionable die heads engage the pipe in the second configuration operative position.

In a sixteenth alternative embodiment according to the fifteenth embodiment, the ratchet mechanism advances the slide rod, the bending mandrel and the pipe receiving channel towards the die heads in the first configuration operative position and the first configuration non-operative position.

In a seventeenth alternative embodiment according to the sixteenth embodiment, the ratchet mechanism advances the slide rod and the die heads towards the pipe receiving channel and the bending mandrel in the second configuration operative position and the second configuration non-operative position.

In an eighteenth alternative embodiment according to the seventeenth embodiment, the die heads extend upwardly from the cross bow bar support in the first bending configuration.

In a nineteenth alternative embodiment according to the eighteenth embodiment, the die heads extend downwardly from the cross bow bar support in the second bending configuration.

In a twentieth alternative embodiment according to the nineteenth embodiment, the cross bow bar support is positioned downwardly and the die heads are positioned upwardly relative to the frame notch in the first bending configuration and the cross bow bar support is positioned upwardly and the die heads are positioned downwardly relative to the first support bracket and the frame notch in the second bending configuration.

The illustrations of the embodiments described herein are intended to provide a general understanding of the structure of the various embodiments. The illustrations are not intended to serve as a complete description of all of the elements and features of apparatus and systems that utilize the structures or methods described herein.

Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized.

Accordingly, the disclosure and the figures are to be regarded as illustrative rather than restrictive. While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment.

Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments, and it should be understood that the described components and systems can generally be integrated together in a single product or packaged into multiple products.

One or more embodiments of the disclosure may be referred to herein, individually and/or collectively, by the term "invention' merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments.

Combinations of the above embodiments, and other embodiments not specifically described herein, are apparent to those of skill in the art upon reviewing the description. It is intended that the foregoing detailed description be regarded as illustrative rather than limiting and that it is understood that the following claims including all equivalents are intended to define the scope of the invention.

The claims should not be read as limited to the described order or elements unless stated to that effect. Therefore, all embodiments that come within the scope and spirit of the following claims and equivalents thereto are claimed as the invention.

While the foregoing is a description of the preferred embodiments for carrying out the invention for the purposes of complying with 37 C.F.R. 1.72., it is also intended in an illustrative rather than a restrictive sense. Variations to the exact embodiment described may be apparent to those skilled in such equipment without departing from the spirit and scope of the invention as defined by the claims set out below.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

I claim:

1. A tubing bender device comprising:

a frame having a handle, a ratchet mechanism engaged to a slide rod and said handle, and a frame notch proximate to an outer end of said frame;

said frame having a first bending configuration further comprising a bending mandrel, said bending mandrel having a first bracket receiving aperture releasably engaged to said slide rod, and said frame having a cross bow bar support releasably engaged to said frame notch, said cross bow bar support comprising a plurality of die heads releasably engaged to said cross bow bar support, said die heads having a degree of revolution relative to said cross bow bar support, and a plurality of repositionable die heads releasably engaged to said cross bow bar support, said repositionable die heads having said degree of revolution relative to said cross bow bar support and a degree of rotation relative to said cross bow bar support, each of said die heads having at least one die head pipe receiving recess having a radius dimension, and each of said repositionable die heads having at least one repositionable die head pipe receiving recess having a radius dimension different from said radius dimension of said die head pipe receiving recess, wherein said die heads or said die heads and said repositionable die heads are aligned relative to said bending mandrel in an first configuration operative position, said die heads or said die heads and said repositionable die heads and said bending mandrel being constructed and arranged for bending a pipe in a first bending direction, and further wherein said repositionable die heads are rotated downwardly below said cross bow bar support in a first configuration non-operative position; and said frame having a second bending configuration comprising a first support bracket releasably engaged to said slide rod, said cross bow bar support being releasably engaged to said first support bracket, a second support bracket releasably engaged to said frame notch, said bending mandrel being releasably engaged to said second support bracket, wherein said die heads or said die heads and said repositionable die heads are aligned relative to said bending mandrel in an second configuration operative position, said die heads or said die heads and said repositionable die heads and said bending mandrel being constructed and arranged for bending said pipe in a second bending direction, said second bending direction being opposite to said first bending direction, wherein said repositionable die heads are rotated upwardly above said cross bow bar support in a second configuration non-operative position.

2. The tubing bender device according to claim 1, wherein said die heads and said repositionable die heads revolve in a clockwise or counter clockwise direction.

3. The tubing bender device according to claim 2, wherein said die heads and said repositionable die heads are releasably secured to said cross bow bar support by a die head attachment wherein said die heads or said repositionable die heads may be interchangeably replaced with substitute die heads or substitute repositionable die heads having said die head pipe receiving recess or said repositionable die head pipe receiving recess of a different size.

4. The tubing bender device according to claim 3, wherein said cross bow bar support has a center and at least one of said repositionable die heads is positioned on one side of said center and at least one of said repositionable die heads is positioned on an opposite side of said center.

5. The tubing bender device according to claim 4, wherein said die heads are positioned on said cross bow bar support exterior to said repositionable die heads.

6. The tubing bender device according to claim 5, said cross bow bar support having a plurality of mounting blocks wherein one of said repositionable die heads is releasably engaged to each of said mounting blocks.

7. The tubing bender device according to claim 6, wherein said cross bow bar support defines a longitudinal axis.

8. The tubing bender device according to claim 7, wherein a shaft rotatably connects each mounting block to said cross bow bar support.

9. The tubing bender device according to claim 8, wherein each of said shafts establish a longitudinal axis of rotation which is substantially parallel to said longitudinal axis.

10. The tubing bender device according to claim 9, wherein said bending mandrel has a pipe receiving channel and said pipe receiving channel is positioned in a direction away from said slide rod in said first configuration operative position and said first configuration non-operative position.

11. The tubing bender device according to claim 10, wherein said pipe receiving channel is positioned in a direction towards said slide rod in said second configuration operative position and said second configuration non-operative position.

12. The tubing bender device according to claim 11, wherein said pipe receiving channel and said die heads engage a pipe in said first configuration non-operative position.

13. The tubing bender device according to claim 12, wherein said pipe receiving channel, said die heads and said repositionable die heads engage said pipe in said first configuration operative position.

14. The tubing bender device according to claim 13, wherein said pipe receiving channel and said die heads engage said pipe in said second configuration non-operative position.

15. The tubing bender device according to claim 14, wherein said pipe receiving channel, said die heads and said repositionable die heads engage said pipe in said second configuration operative position.

16. The tubing bender device according to claim 15, wherein said ratchet mechanism advances said slide rod, said bending mandrel and said pipe receiving channel towards said die heads in said first configuration operative position and said first configuration non-operative position.

17. The tubing bender device according to claim 16, wherein said ratchet mechanism advances said slide rod and said die heads towards said pipe receiving channel and said bending mandrel in said second configuration operative position and said second configuration non-operative position.

18. The tubing bender device according to claim 17, wherein said die heads extend upwardly from said cross bow bar support in said first bending configuration.

19. The tubing bender device according to claim 18, wherein said die heads extend downwardly from said cross bow bar support in said second bending configuration.

20. The tubing bender device according to claim 19, wherein said cross bow bar support is positioned downwardly and said die heads are positioned upwardly relative to said frame notch in said first bending configuration and said cross bow bar support is positioned upwardly and said die heads are positioned downwardly relative to said first support bracket and said frame notch in said second bending configuration.

* * * * *